US009887502B2

(12) United States Patent
Yoshioka et al.

(10) Patent No.: US 9,887,502 B2
(45) Date of Patent: Feb. 6, 2018

(54) CONNECTOR STRUCTURE, JACK, PLUG, AND ELECTRONIC DEVICE

(71) Applicant: KYOCERA CORPORATION, Kyoto (JP)

(72) Inventors: Yuki Yoshioka, Daito (JP); Yasuo Nambu, Osaka (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/294,209

(22) Filed: Oct. 14, 2016

(65) Prior Publication Data

US 2017/0033517 A1 Feb. 2, 2017

Related U.S. Application Data

(63) Continuation of application No. PCT/JP2016/055585, filed on Feb. 25, 2016.

(30) Foreign Application Priority Data

Feb. 25, 2015 (JP) ..... 2015-034642

(51) Int. Cl.
*H01R 24/58* (2011.01)
*H01R 13/625* (2006.01)
(Continued)

(52) U.S. Cl.
CPC ..... *H01R 24/58* (2013.01); *H01R 13/625* (2013.01); *H01R 13/639* (2013.01); *H01R 4/54* (2013.01);
(Continued)

(58) Field of Classification Search
CPC ..... H01R 13/629; H01R 13/62933; H01R 13/625; H01R 4/54; H01R 33/46;
(Continued)

(56) References Cited

U.S. PATENT DOCUMENTS 5,980,278 A * 11/1999 Winkler ..... H01R 13/5213 439/142
6,030,247 A * 2/2000 Sasahara ..... H01R 13/20 439/332
7,175,459 B2 * 2/2007 Milner ..... H01R 13/5213 439/271

FOREIGN PATENT DOCUMENTS

JP 10-208813 8/1998
JP 2004-87185 3/2004
(Continued)

OTHER PUBLICATIONS

Written Opinion of the International Searching Authority and Concise Explanation Thereof.

*Primary Examiner* — Abdullah Riyami
*Assistant Examiner* — Justin Kratt
(74) *Attorney, Agent, or Firm* — Duane Morris LLP

(57) ABSTRACT

A connector structure includes a jack including a receiver, and a plug connectable to the jack. The jack includes a wall located around the receiver and defining a receiving region configured to receive a locking portion. The plug includes a plug body, a plug holder, and the locking portion. The receiving region includes a first region where at least a part of the locking portion is configured to enter and exit by a movement of the locking portion along the first axis, and a second region where at least a part of the locking portion is configured to enter when the locking portion is rotated about the first axis. The second region is covered by the wall when the receiver is seen from the front.

19 Claims, 9 Drawing Sheets

(51) Int. Cl.

| | |
|---|---|
| ***H01R 13/639*** | (2006.01) |
| *H01R 13/52* | (2006.01) |
| *H01R 4/00* | (2006.01) |
| *H01R 13/629* | (2006.01) |
| *H01R 33/965* | (2006.01) |
| *H01R 33/46* | (2006.01) |
| *H01R 103/00* | (2006.01) |

(52) U.S. Cl.
CPC ..... *H01R 13/52* (2013.01); *H01R 13/5202* (2013.01); *H01R 13/5219* (2013.01); *H01R 13/629* (2013.01); *H01R 13/62933* (2013.01); *H01R 33/46* (2013.01); *H01R 33/965* (2013.01); *H01R 2103/00* (2013.01)

(58) Field of Classification Search
CPC ..... H01R 13/5202; H01R 13/5219; H01R 33/965; H01R 13/52
USPC ..... 439/307, 296, 668, 310, 311, 332, 546, 439/271, 272, 587
See application file for complete search history.

(56) References Cited

FOREIGN PATENT DOCUMENTS

| | | | | |
|---|---|---|---|---|
| JP | 2004087185 | A | * | 3/2004 |
| JP | 2007-149499 | A | | 6/2007 |
| JP | 2010-86820 | | | 4/2010 |
| JP | 2013-149371 | | | 8/2013 |

* cited by examiner

CONNECTOR STRUCTURE, JACK, PLUG, AND ELECTRONIC DEVICE

CROSS-REFERENCE TO RELATED APPLICATION

The present application is a continuation based on PCT Application No. PCT/JP2016/055585 filed on Feb. 25, 2016, which claims the benefit of Japanese Application No. 2015-034642, filed on Feb. 25, 2015. PCT Application No. PCT/JP2016/055585 is entitled "Connector Structure, Jack, Plug, and Electronic Device", and Japanese Application No. 2015-034642 is entitled "Connector Assembly Structure, Jack Module, Plug Module, and Electronic Device." The content of which are incorporated by reference herein in their entirety.

FIELD

Embodiments of the present disclosure relate to a connector structure, a jack, a plug, and an electronic device.

BACKGROUND

There is a connector including a plug and a jack.

SUMMARY

A connector structure based on the present disclosure includes a jack including a receiver, and a plug connectable to the jack. The jack includes a wall located around the receiver and defining a receiving region configured to receive a locking portion. The plug includes a plug body to be inserted into the receiver along a first axis, a plug holder configured to hold the plug body, and the locking portion including a portion projecting from the plug holder at least laterally, at least a part of the locking portion being inserted into the receiving region. The receiving region includes a first region where at least a part of the locking portion is configured to enter and exit by a movement of the locking portion along the first axis, and a second region where at least a part of the locking portion is configured to enter when the locking portion is rotated about the first axis with at least the part of the locking portion being inserted into the first region. The second region is covered by the wall when the receiver is seen from the front.

The foregoing and other objects, features, aspects and advantages of the present disclosure will become more apparent from the following detailed description of the present disclosure when taken in conjunction with the accompanying drawings.

DETAILED DESCRIPTION (First Embodiment)

Figure 1:
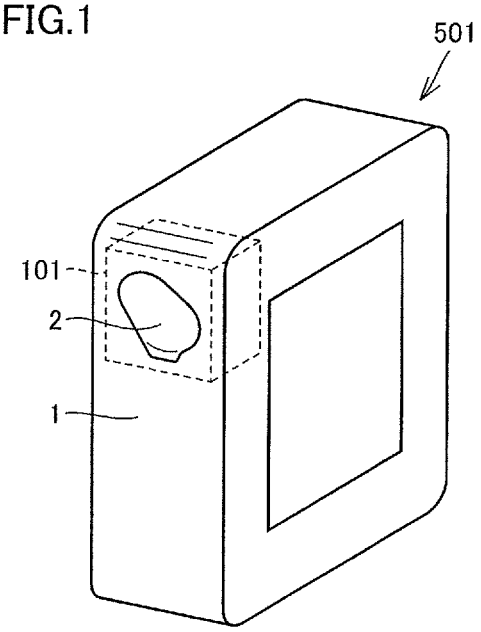
FIG. 1 is a perspective view of an electronic device according to a first embodiment based on the present disclosure.

Referring to FIG. 1, an electronic device according to a first embodiment based on the present disclosure will be described. An electronic device 501 includes a housing 1 and a cap 2. Electronic device 501 includes a jack 101 which will be described later. Jack 101 is located in housing 1. Although the shape of jack 101 is schematically indicated as a rectangular parallelepiped by the broken line, the actual shape and size of jack 101 are not limited to this. Jack 101 may have a size that occupies the most part of housing 1.

Since electronic device 501 according to the first embodiment includes jack 101, a plug can be less likely to be fallen out even when an excessive tensile force is exerted. The details of jack 101 will be described later.

(Second Embodiment)

Figure 2:
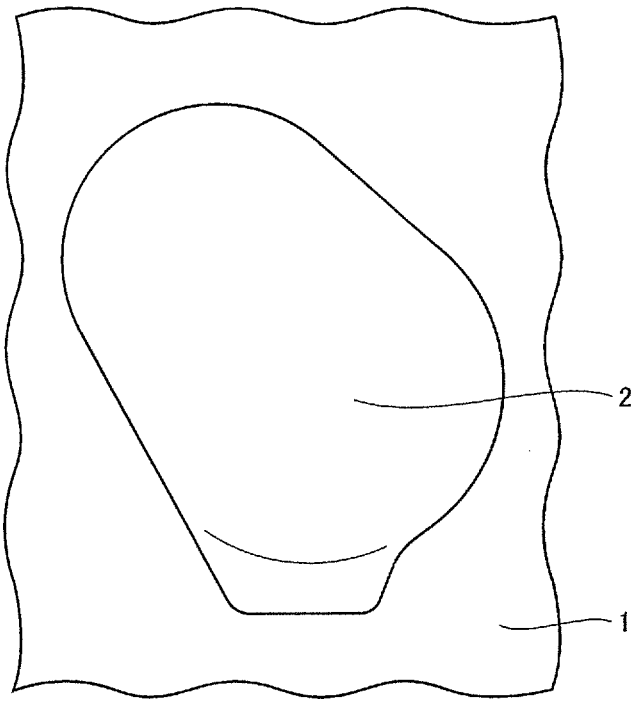
FIG. 2 is an enlarged plan view of and around a cap of a jack included in a connector structure according to a second embodiment based on the present disclosure, with the cap being closed.
Figure 3:
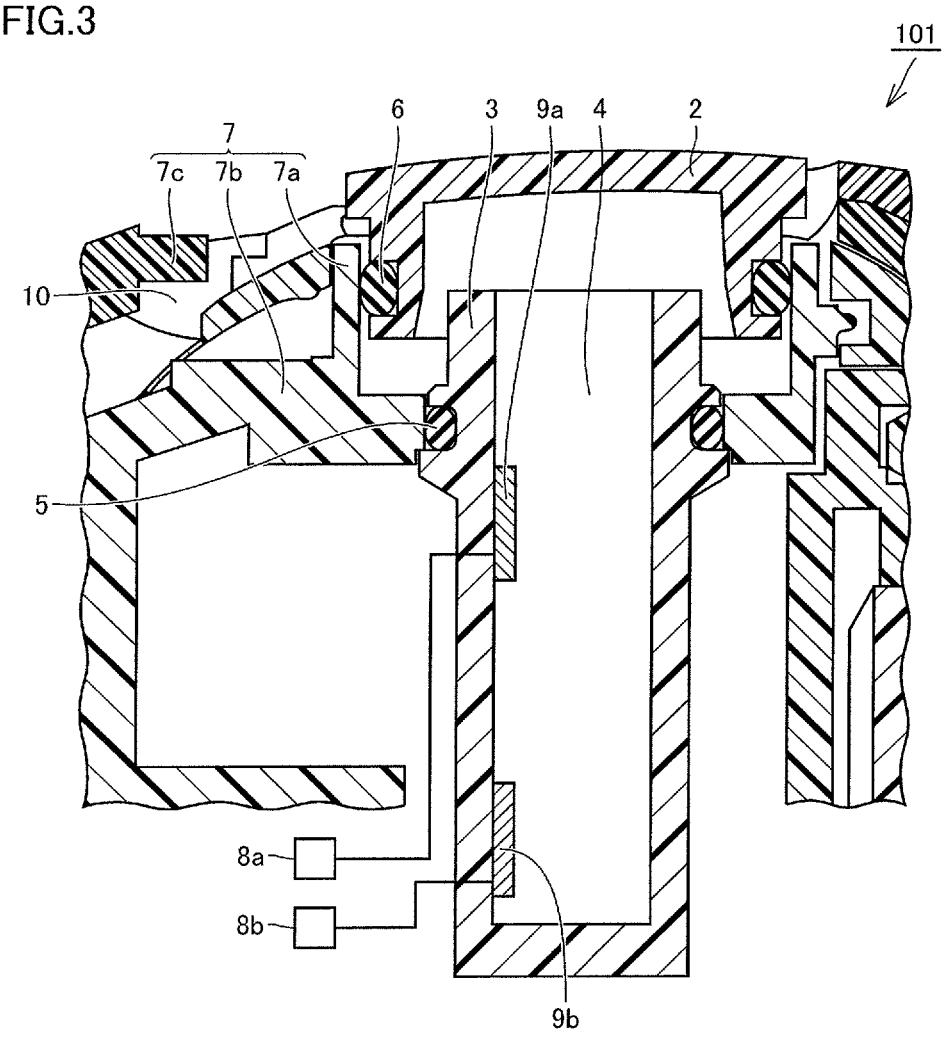
FIG. 3 is a cross-sectional view of the jack included in the connector structure according to the second embodiment based on the present disclosure.

Referring to FIGS. 2 to 9, a connector structure according to a second embodiment based on the present disclosure will be described. The connector structure includes a jack and a plug. The structure of the jack will be described first. As shown in FIG. 1, jack 101 is located in electronic device 501. FIG. 2 shows cap 2 shown in FIG. 1 and its neighborhood in an enlarged scale. FIG. 2 shows cap 2 as seen from the front side. The shape of cap 2 shown here is merely an example, and is not limited to such a shape. FIG. 3 is a cross-sectional view of jack 101 with cap 2 being closed. The presence of cap 2 itself is not indispensable for jack 101.

As shown in FIG. 3, a jack body 3 including a receiver 4 is located in cap 2. A wall 7 is located around jack body 3. Jack 101 includes wall 7. Wall 7 includes portions 7*a*, 7*b* and 7*c*. Wall 7 defines a receiving region 10 surrounded by portions 7*a*, 7*b* and 7*c*. Receiving region 10 is intended for receiving a locking portion. Receiving region 10 is located on the outer side of portion 7*a* as seen from jack body 3. Portions 7*a* and 7*b* are made of a waterproof material. Jack body 3 is in contact with portion 7*b* of wall 7 with a packing 5 located therebetween. Cap 2 is in contact with portion 7*b* with a packing 6 located therebetween. Packing 6 seals a gap between jack body 3 and portion 7*b* such that water does not pass therethrough. Electrodes 9*a* and 9*b* are exposed at the inner surface of receiver 4 of jack body 3.

The outer surface of jack 101 is divided into a waterproof region and a non-waterproof region. In the example shown in FIG. 3, the waterproof region and the non-waterproof region are separated by jack body 3, packing 5 and wall 7.

For example, the upper surface of portion 7*b* of wall 7 in FIG. 3 is included in the non-waterproof region. The inner surface of receiver 4 of jack body 3 is included in the non-waterproof region. The outer surface of jack body 3 located above packing 5 is included in the non-waterproof region. The lower surface of portion 7*b* is included in the waterproof region. The outer surface of jack body 3 located below packing 5 is included in the waterproof region.

Portion 7*a* projects like a wall. Portion 7*a* may be annular, but may not be perfectly annular.

Electrodes 8*a* and 8*b* are located in the waterproof region. Electrode 8*a* is electrically connected to electrode 9*a*. Electrode 8*b* is electrically connected to electrode 9*b*. In FIG. 3, the shape of electrodes 8*a*, 8*b*, 9*a*, and 9*b* is shown schematically, and their actual shape and positional relation are not limited as such.

Figure 4:
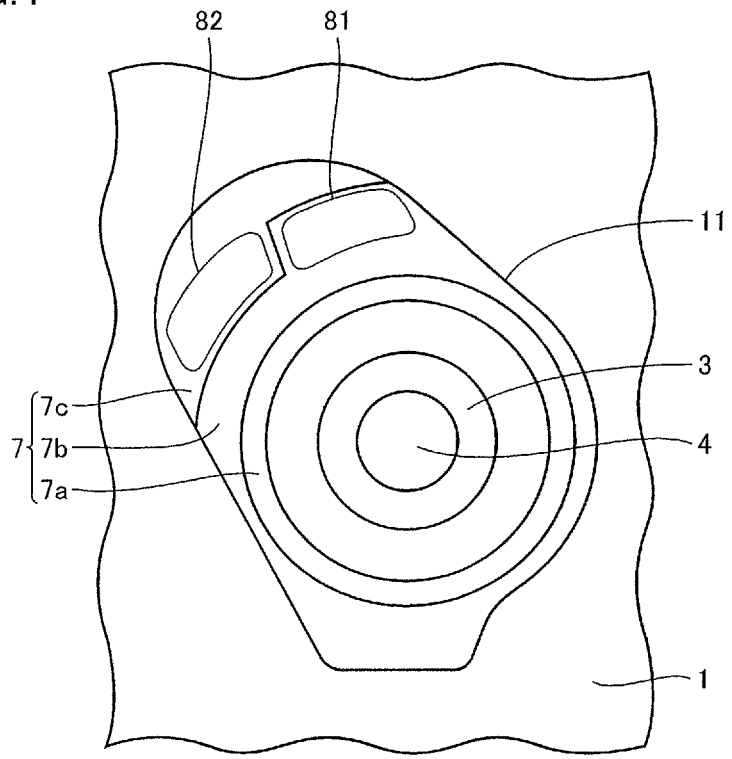
FIG. 4 is an enlarged plan view of and around an opening of the jack included in the connector structure according to the second embodiment based on the present disclosure, with the cap being opened.

FIG. 4 is a plan view of a state with cap 2 being opened. Cap 2 in the opened state may be removed completely or may remain connected to housing 1 with any component. Cap 2 is not illustrated in FIG. 4. In this state, an opening 11 is visible since cap 2 has been removed. The shape of opening 11 conforms to the shape of cap 2. The shape of opening 11 may be asymmetric in this manner. The shape of opening 11 shown here is merely an example, and is not limited to such a shape. The shape of opening 11 may differ greatly from the shape of cap 2.

In FIG. 4, jack body 3 is visible within opening 11. Receiver 4 in the opened state is visible at the center of jack body 3. Portion 7*a* is visible in a manner surrounding jack body 3. Portion 7*c* is visible at one end of opening 11. Portion 7*c* is visible at a position closer to this side than portion 7*b*. In FIG. 4, first region 81 and second region 82 are indicated by the thin lines. First region 81 refers to a region located closer to this side than portion 7*b* and is directly visible. Second region 82 refers to a region located closer to this side than portion 7*b* and hidden by portion 7*c*.

Figure 5:
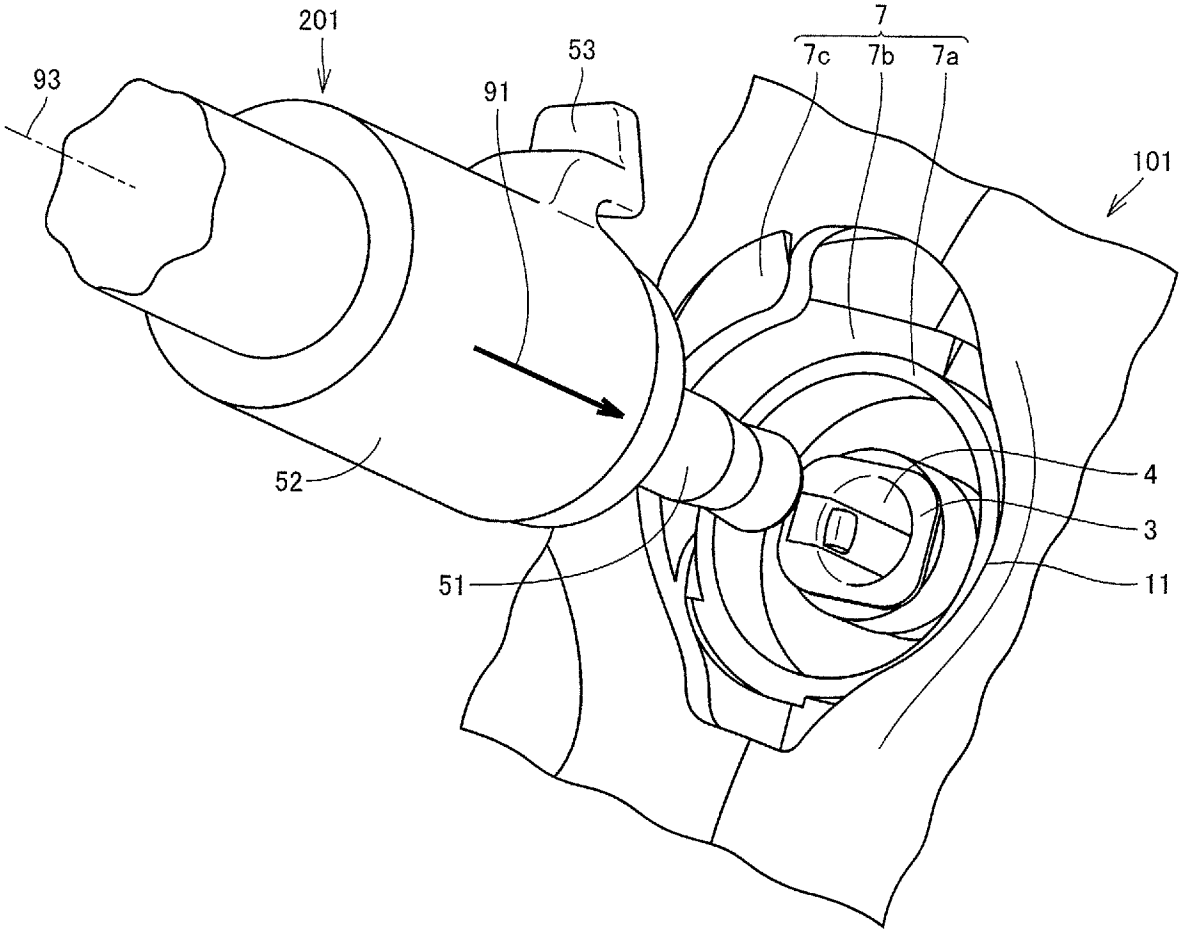
FIG. 5 is an explanatory drawing of a first stage of an operation of connecting the connector structure according to the second embodiment based on the present disclosure.
Figure 6:
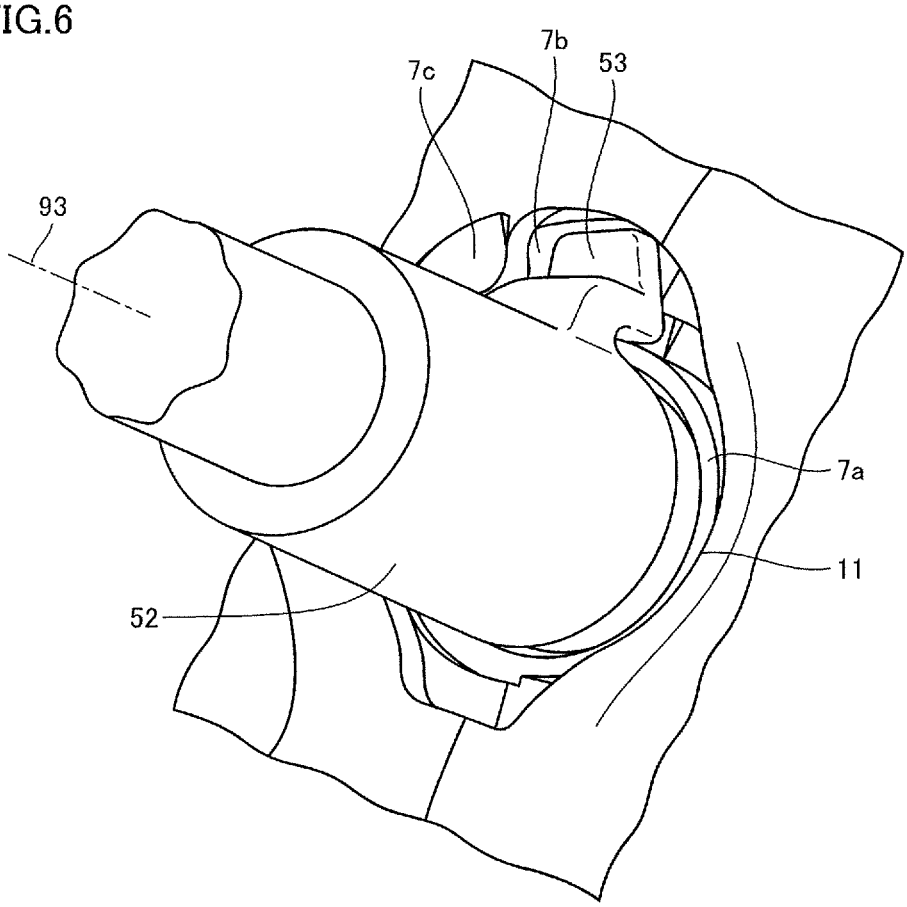
FIG. 6 is an explanatory drawing of a second stage of the operation of connecting the connector structure according to the second embodiment based on the present disclosure.
Figure 7:
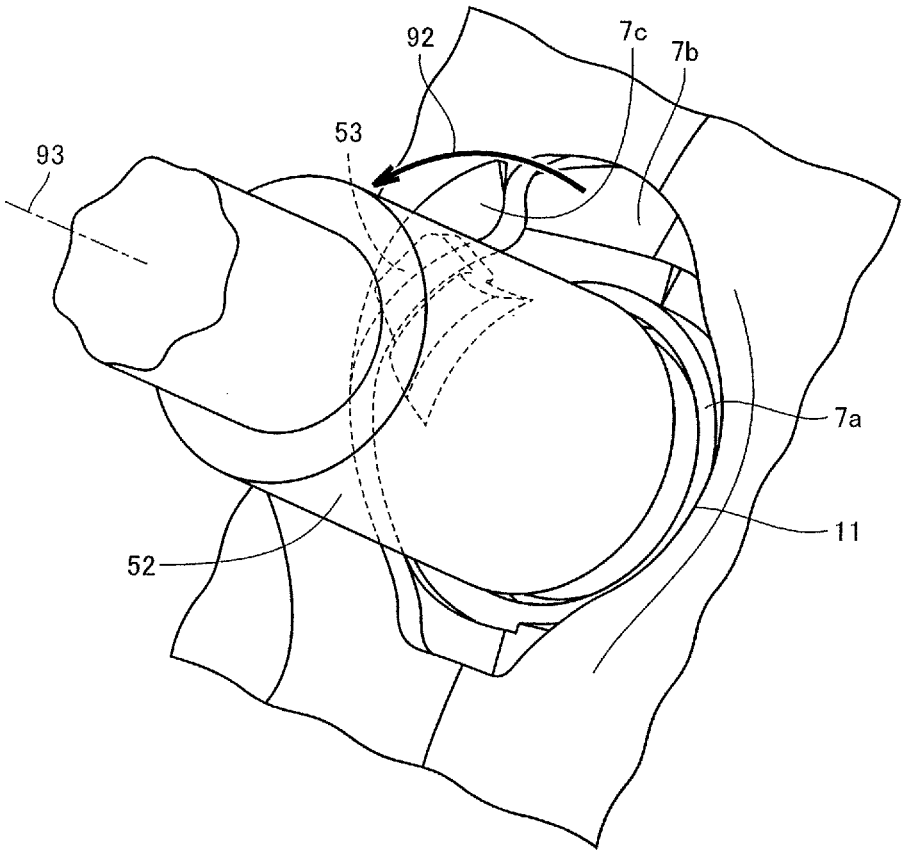
FIG. 7 is an explanatory drawing of a third stage of the operation of connecting the connector structure according to the second embodiment based on the present disclosure.

Referring to FIGS. 5 to 7, an operation of connecting the connector structure according to the second embodiment based on the present disclosure will be described.

As shown in FIG. 5, a plug 201 enters jack 101 as indicated by an arrow 91, The center line of plug 201 is a first axis 93. Arrow 91 is in parallel to first axis 93. A plug body 51 is located at the tip of plug 201 so as to project in a direction parallel to first axis 93. Plug body 51 is held by a plug holder 52. Plug holder 52 is also a part of plug 201. At least a part of plug body 51 is made of a conductor. Plug holder 52 is mainly made of an insulator. Plug 201 includes a locking portion 53 projecting laterally from plug holder 52. Locking portion 53 advances toward first region 81. Since first region 81 is exposed directly without being covered by portion 7*c*, the tip of locking portion 53 can arrive at first region 81 by moving along first axis 93. FIG. 6 shows that plug 201 has completed entrance in the direction of arrow 91. The tip of locking portion 53 has already been fitted within first region 81. At this time, the tip of locking portion 53 is visible. In this state, insertion has been completed, but the connector is in an unlocked state.

Figure 8:
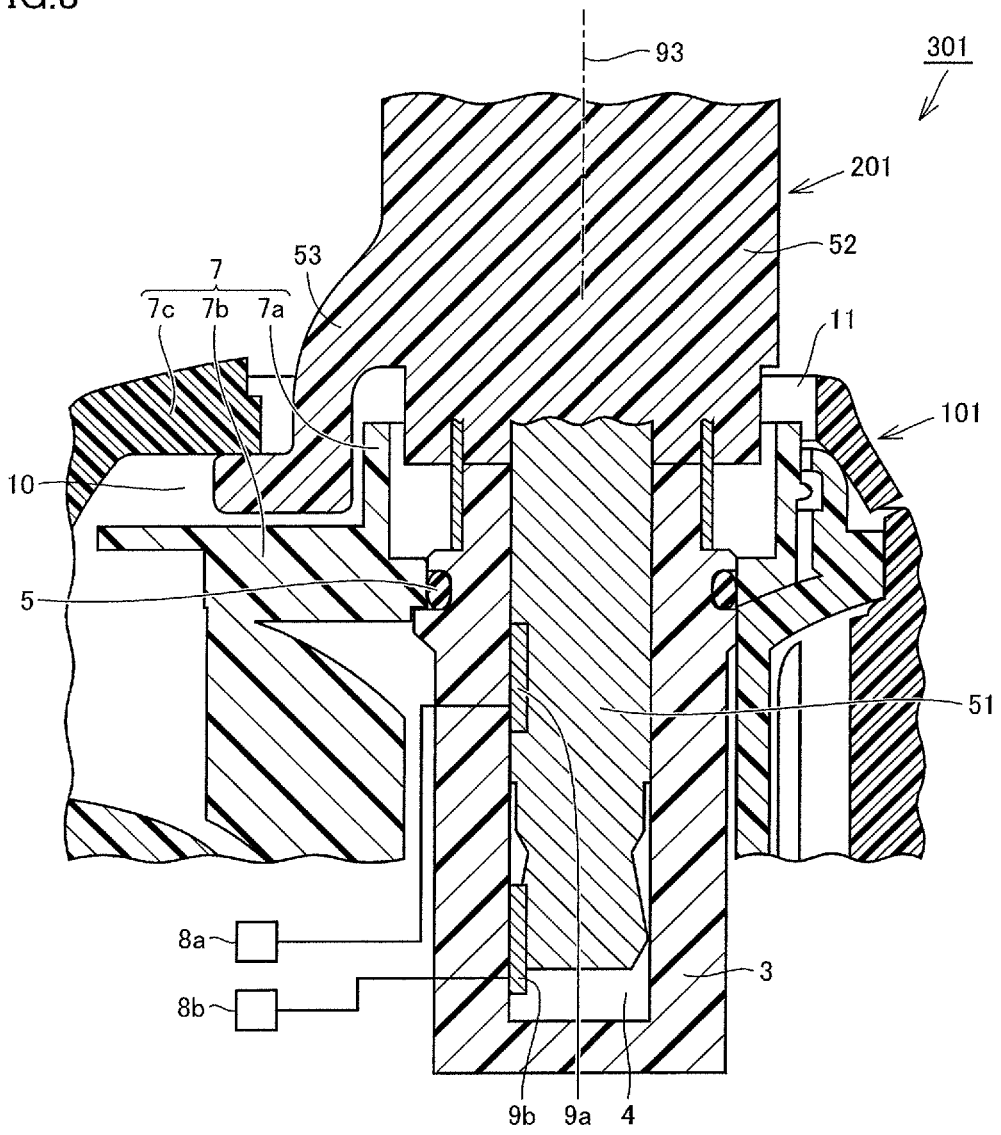
FIG. 8 is a cross-sectional view of the connector structure according to the second embodiment based on the present disclosure.

Plug 201 is then rotated in the direction of arrow 92 as shown in FIG. 7. Arrow 92 indicates the rotation about first axis 93. The rotation angle may be 50°, for example. Since plug 201 is rotated while remaining inserted in jack 101, locking portion 53 is moved rotationally about first axis 93. With the rotational movement of locking portion 53, the tip of locking portion 53 has entered the back side of portion 7*c* of wall 7. In this state, the locking of the connector has been completed. FIG. 8 shows a cross-sectional view of this state. FIG. 8 shows a section taken in a different direction from FIG. 3. In the state shown in FIG. 8, portion 7*a* of wall 7 is located so as to surround plug holder 52. Locking portion 53 has reached the outer side of portion 7*a* over portion 7*a*.

Figure 9:
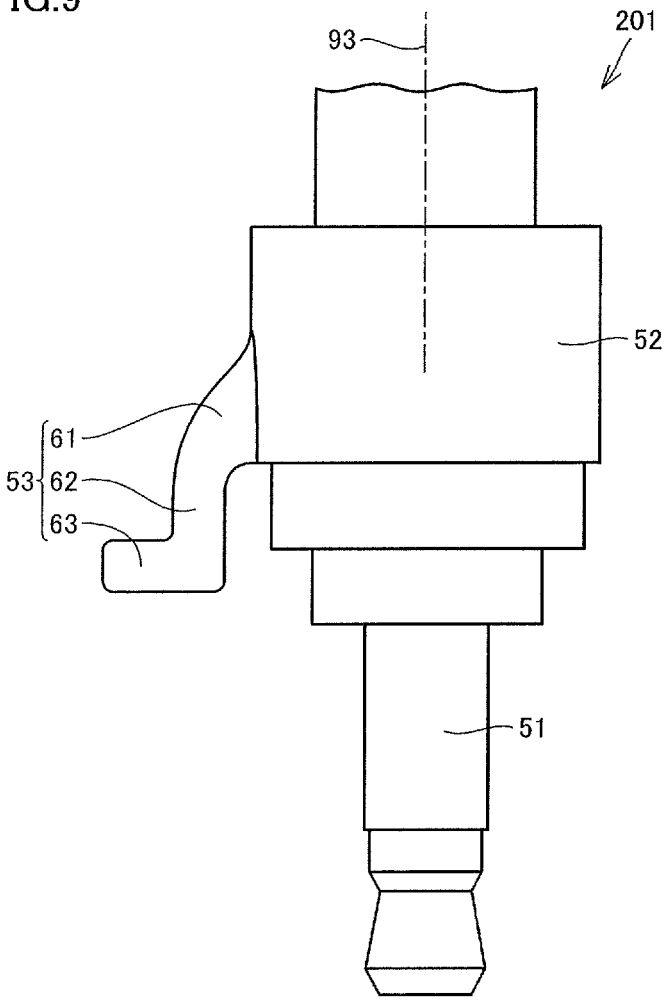
FIG. 9 is a side view of a plug according to the second embodiment based on the present disclosure.

FIG. 9 shows plug 201 as taken out independently. Plug 201 includes plug body 51, plug holder 52 and locking portion 53.

Since locking can be achieved using locking portion 53 in the connector structure according to the second embodiment, the plug can be less likely to fall out from the jack even when an excessive tensile force is exerted.

(Third Embodiment)

Figure 10:
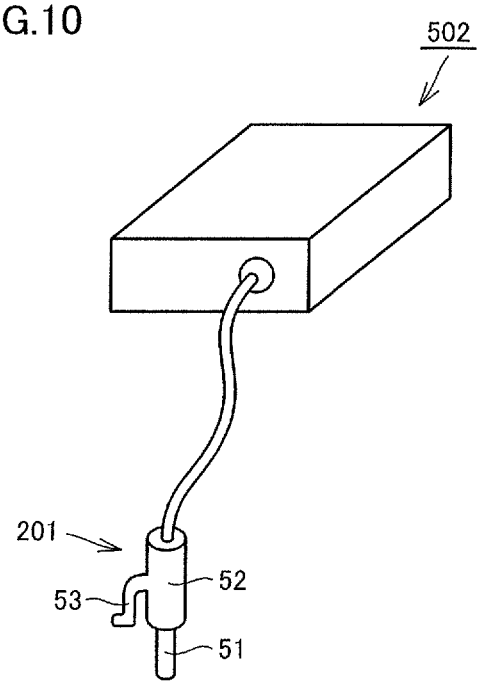
FIG. 10 is a conceptual view of an electronic device according to a third embodiment based on the present disclosure.

Referring to FIG. 10, an electronic device according to a third embodiment based on the present disclosure will be described. An electronic device 502 includes any of plugs 201 based on the present disclosure. Plug 201 includes plug body 51, plug holder 52 and locking portion 53. The details of plug 201 will be described later.

Since electronic device 502 according to the third embodiment includes plug 201, the plug can be less likely to fall out from the jack even when an excessive tensile force is exerted.

(Fourth Embodiment)

Figure 11:
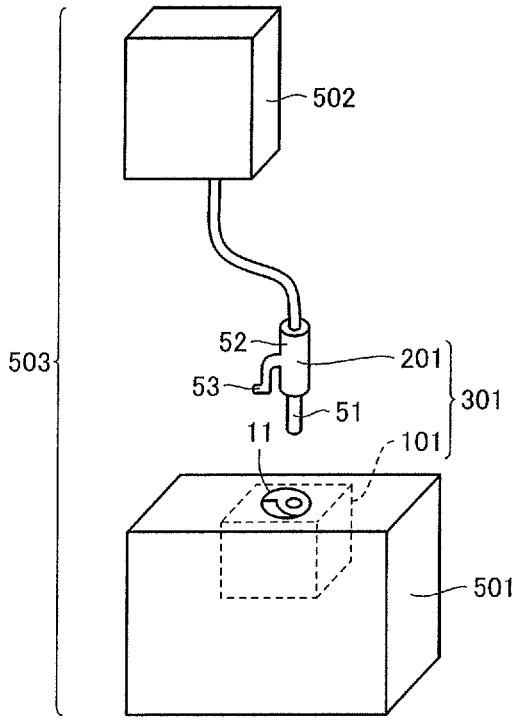
FIG. 11 is a conceptual view of an electronic device according to a fourth embodiment based on the present disclosure.

Referring to FIG. 11, an electronic device according to a fourth embodiment based on the present disclosure will be described. An electronic device 503 includes electronic device 501 and electronic device 502. Electronic device 503 includes any of connector structures 301 based on the present disclosure. Connector structure 301 includes jack 101 and plug 201. Electronic device 501 includes jack 101. Opening 11 of jack 101 is located in the outer surface of electronic device 501. The details of connector structure 301 will be described later.

Since electronic device 503 according to the fourth embodiment includes connector structure 301, the plug is less likely to fall out from the jack even when an excessive tensile force is exerted.

Although electronic devices 501, 502 included in electronic device 503 are each shown as having a box-like shape in FIG. 11, this is merely a schematic illustration. Actually, the shape of electronic devices 501, 502 is not limited to this. Electronic devices 501, 502 may be in various forms depending on their applications.

The disclosure in the above-described embodiments will be summarized now for clarification. Some description about structural variations will also be added.

(Connector Structure)

Connector structure 301 includes jack 101 including receiver 4 and plug 201 connectable to jack 101. Jack 101 includes wall 7 located around receiver 4. Wall 7 defines receiving region 10 for receiving a locking portion. Plug 201 includes plug body 51 to be inserted into receiver 4 along first axis 93, plug holder 52 holding plug body 51, and locking portion 53 including a portion projecting from plug holder 52 at least laterally, at least a part of locking portion 53 being inserted into receiving region 10.

Receiving region 10 includes first region 81 where at least a part of locking portion 53 can enter and exit by the movement of locking portion 53 along first axis 93, and second region 82 where at least a part of locking portion 53 can enter when locking portion 53 is rotated about first axis 93 with at least the part of locking portion 53 being inserted into first region 81.

When receiver 4 is seen from the front, second region 82 is covered by wall 7. In more detail, second region 82 is covered by portion 7*c* which is a part of wall 7.

By employing this structure, the locking of connector structure 301 can be achieved using locking portion 53, and the plug can be less likely to fall out from the jack even when an excessive tensile force is exerted.

In connector structure 301, as shown in FIG. 9, locking portion 53 may include a first portion 61 projecting laterally from plug holder 52, a second portion 62 extending from first portion 61 along first axis 93, and a third portion 63 extending laterally from an end of second portion 62 opposite to first portion 61. By employing this structure, even if there is a wall-like projection between jack body 3 and receiving region 10, it is possible to cause third portion 63 to reach receiving region 10 beyond the projection.

When a force which is smaller than or equal to a predetermined reference value is applied in a direction that plug 201 is pulled away from jack 101 with at least a part of locking portion 53 being located in second region 82, wall 7 covering second region 82 comes into contact with at least the part of locking portion 53 to make plug 201 unlikely to be pulled out from jack 101. If the force exceeds the reference value, locking portion 53 may be able to be removed from receiving region 10 by elastic deformation of at least one of locking portion 53 and wall 7. By employing this structure, locking portion 53 can be less likely to be damaged.

As shown in FIG. 3, jack 101 included in connector structure 301 may include cap 2 capable of at least closing receiver 4 when plug 201 is not connected thereto. By employing this structure, jack body 3 can be protected. By closing opening 11 with cap 2 when jack 101 is not connected with plug 201, the likelihood that foreign substances will enter receiver 4 can be reduced.

As described in the second embodiment, in connector structure 301, the outer surface of jack 101 is divided into the waterproof region and the non-waterproof region, and receiver 4 and receiving region 10 may be exposed in the non-waterproof region. When the outer surface of jack 101 is divided into the waterproof region and the non-waterproof region in this way, the plug can be less likely to fall out from the jack even when an excessive tensile force is exerted, while maintaining waterproofness of the waterproof region.

As described in the second embodiment, connector structure 301 may include electrodes 8*a* and 8*b* within jack 101, and an electric connection may be made between electrodes 8*a*, 8*b* and at least a part of the inner surface of receiver 4. By employing this structure, an electric connection using electrodes between the surface of the plug inserted in receiver 4 and the inside of jack 101 can be achieved reliably. "At least a part of the inner surface of receiver 4" refers to electrodes 9*a* and 9*b*, for example.

(Jack)

Jack 101 is jack 101 including receiver 4, and includes wall 7 around receiver 4. Wall 7 defines receiving region 10. Receiving region 10 is intended for receiving a locking portion. Receiving region 10 includes first region 81 where at least a part of locking portion 53 can enter and exit by the movement of locking portion 53 along first axis 93, and second region 82 where at least a part of locking portion 53 can enter when locking portion 53 is rotated about first axis 93 with at least the part of locking portion 53 being inserted into first region 81. When receiver 4 is seen from the front, second region 82 is covered by wall 7. By employing this structure, the locking can be achieved in jack 101 using locking portion 53 located on the plug 201 side, and the plug is less likely to fall out from the jack even when an excessive tensile force is exerted.

Jack 101 described above may include cap 2 capable of at least closing receiver 4 when plug 201 is not connected thereto. By employing this structure, jack body 3 can be protected. By closing opening 11 with cap 2 when jack 101 is not connected with plug 201, the likelihood that foreign substances will enter receiver 4 can be reduced.

Cap 2 may include packing 6, and may be configured such that packing 6 is pressed against a part of wall 7 with cap 2 being closed. By employing this structure, the likelihood that foreign substances will enter receiver 4 through a gap around cap 2 while cap 2 is closed can be reduced. "A part of wall 7" refers to portion 7*a*, for example. In the example shown here, cap 2 includes a cylindrical portion on the back surface, and packing 6 is an annular component and is located so as to surround this cylindrical portion. Portion 7*a*, which is a part of wall 7, is a wall-like portion located so as to surround the cylindrical portion of the back surface of cap 2 with cap 2 being closed. With cap 2 being closed, portion 7*a* and cap 2 are in contact with each other with packing 6 located therebetween. Packing 6 may be waterproof Packing 6 may be resistant to dust.

As described in the second embodiment, the outer surface of jack 101 is divided into the waterproof region and the non-waterproof region, and receiver 4 and receiving region 10 may be exposed in the non-waterproof region. When the outer surface of jack 101 is divided into the waterproof region and the non-waterproof region in this way, the plug can be less likely to fall out from the jack even when an excessive tensile force is exerted, while maintaining waterproofness of the waterproof region.

As described in the second embodiment, jack 101 may include electrodes 8*a* and 8*b* therein, and an electric connection may be made between electrodes 8*a*, 8*b* and at least a part of the inner surface of receiver 4. By employing this structure, an electric connection can be achieved reliably using the electrodes between the surface of the plug inserted in receiver 4 and the inside of jack 101. "At least a part of the inner surface of receiver 4" refers to electrodes 9*a* and 9*b*, for example.

(Plug)

As shown in FIG. 9, plug 201 is plug 201 connectable to jack 101, and includes plug body 51 to be inserted into receiver 4 located in jack 101 along first axis 93, plug holder 52 holding plug body 51, and locking portion 53 including a portion projecting from plug holder 52 at least laterally, at least a part of locking portion 53 being inserted into receiving region 10 located in jack 101. By employing this structure, plug 201 can be locked after being connected to jack 101, and the plug can thus be less likely to fall out from the jack even when an excessive tensile force is exerted.

In plug 201 described above, locking portion 53 may include first portion 61 projecting laterally from plug holder 52, second portion 62 extending from first portion 61 along first axis 93, and third portion 63 extending laterally from an end of second portion 62 opposite to first portion 61. By employing this structure, even if there is a wall-like projection between jack body 3 and receiving region 10, it is possible to cause third portion 63 to reach receiving region 10 beyond the projection.

Each of the above-described embodiments shows an example where one plug includes only one locking portion, but one plug may include a plurality of locking portions.

The shape of the locking portion shown in each of the above-described embodiments is merely an example, and is not a limitation. Other locking portions of various shapes are conceivable. The same applies to the shape of the wall.

Some of the above-described embodiments combined as appropriate may be adopted.

The term "electronic device" as used herein has a broad concept including, for example, a mobile phone, a personal digital assistant, a tablet terminal, a personal computer, a game machine, a television set, a portable music player, a CD (Compact Disc) player, a DVD (Digital Versatile Disc) player, an electronic dictionary, a digital book reader, a digital camera, a video camera, a radio set, a car navigation system, and the like. A smartphone is included in the concept of a mobile phone or a personal digital assistant.

Although the present disclosure has been described and illustrated in detail, it is clearly understood that the same is by way of illustration and example only and is not to be taken by way of limitation, the scope of the present disclosure being interpreted by the terms of the appended claims.

The invention claimed is:

1. A connector structure comprising:

a jack including a receiver; and a plug connectable to the jack, the jack including a wall located around the receiver and defining a receiving region configured to receive a locking portion, the plug including:

a plug body to be inserted into the receiver along a first axis;

a plug holder configured to hold the plug body; and the locking portion including a portion projecting from the plug holder at least laterally, at least a part of the locking portion being inserted into the receiving region, the receiving region including:

a first region where at least a part of the locking portion is configured to enter and exit by a movement of the locking portion along the first axis; and a second region where at least a part of the locking portion is configured to enter when the locking portion is rotated about the first axis with at least the part of the locking portion being inserted into the first region, the second region being located behind the wall when the receiver is viewed in a direction parallel to the first axis, wherein when a force which is smaller than or equal to a predetermined reference value is applied in a direction that the plug is pulled away from the jack with at least the part of the locking portion being located in the second region, the wall covering the second region comes into contact with at least the part of the locking portion to make the plug unlikely to be pulled out from the jack, and when the force exceeds the reference value, the locking portion is configured to be removed from the second region by elastic deformation of at least one of the locking portion and the wall.

2. The connector structure according to claim 1, wherein the locking portion includes:

a first portion projecting laterally from the plug holder;

a second portion extending from the first portion along the first axis; and a third portion extending laterally from an end of the second portion opposite to the first portion.

3. The connector structure according to claim 1, wherein the jack includes a cap configured to close at least the receiver with the plug not being connected thereto.

4. The connector structure according to claim 1, wherein the outer surface of the jack is divided into a waterproof region and a non-waterproof region, and the receiver and the receiving region are exposed in the non-waterproof region.

5. The connector structure according to claim 1, wherein the jack includes an electrode therein, and an electric connection is made between the electrode and a conductive contact located on an inner surface of the receiver.

6. An electronic device comprising the connector structure as defined in claim 1.

7. A jack comprising:

a receiver configured to receive a plug including a locking portion; and a wall located around the receiver and defining a receiving region configured to receive the locking portion, the receiving region including:

a first region where at least a part of the locking portion is configured to enter and exit by a movement of the locking portion along a first axis; and a second region where at least a part of the locking portion is configured to enter when the locking portion is rotated about the first axis with at least the part of the locking portion being inserted into the first region, the second region being located behind the wall when the receiver is viewed in a direction parallel to the first axis, wherein when a force which is smaller than or equal to a predetermined reference value is applied in a direction that the plug is pulled away from the jack with at least the part of the locking portion being located in the second region, the wall covering the second region comes into contact with at least the part of the locking portion to make the plug unlikely to be pulled out from the jack, and when the force exceeds the reference value, the wall is configured to elastically deform so as to allow removal of the locking portion from the second region.

8. The jack according to claim 7, comprising a cap configured to close at least the receiver with the plug not being connected thereto.

9. The jack according to claim 8, wherein the cap includes a packing, and the packing is pressed against a part of the wall with the cap being closed.

10. The jack according to claim 7, wherein the outer surface of the jack is divided into a waterproof region and a non-waterproof region, and the receiver and the receiving region are exposed in the non-waterproof region.

11. The jack according to claim 7, comprising an electrode therein, wherein an electric connection is made between the electrode and a conductive contact located on an inner surface of the receiver.

12. An electronic device comprising the jack as defined in claim 7.

13. A plug comprising:

a plug body to be inserted into a receiver along a first axis, the receiver being located in a jack and configured to receive the plug;

a plug holder configured to hold the plug body; and a locking portion including a portion projecting from the plug holder at least laterally, at least a part of the locking portion being inserted into a receiving region located in the jack and configured to receive the locking portion, wherein the locking portion comprises:

a first portion projecting laterally from the plug holder;

a second portion extending from the first portion along the first axis; and a third portion extending laterally from an end of the second portion opposite to the first portion.

14. An electronic device comprising the plug as defined in claim 13.

15. A connector structure comprising:

a jack including a receiver; and a plug connectable to the jack, the jack including a wall located around the receiver and defining a receiving region configured to receive a locking portion, the plug including:

a plug body to be inserted into the receiver along a first axis;

a plug holder configured to hold the plug body; and the locking portion including a portion projecting from the plug holder at least laterally, at least a part of the locking portion being inserted into the receiving region;

the receiving region including:

a first region where at least a part of the locking portion is configured to enter and exit by a movement of the locking portion along the first axis; and a second region where at least a part of the locking portion is configured to enter when the locking portion is rotated about the first axis with at least the part of the locking portion being inserted into the first region, the second region being located behind the wall when the receiver is viewed in a direction parallel to the first axis, and wherein the locking portion includes:

a first portion projecting laterally from the plug holder;

a second portion extending from the first portion along the first axis; and a third portion extending laterally from an end of the second portion opposite to the first portion.

16. The connector structure according to claim 15, wherein the jack includes a cap configured to close at least the receiver with the plug not being connected thereto.

17. The connector structure according to claim 15, wherein the outer surface of the jack is divided into a waterproof region and a non-waterproof region, and the receiver and the receiving region are exposed in the non-waterproof region.

18. The connector structure according to claim 15, wherein the jack includes an electrode therein, and an electric connection is made between the electrode and a conductive contact located on an inner surface of the receiver.

19. An electronic device comprising the connector structure as defined in claim 15.

* * * * *